US007398755B1

(12) United States Patent
Zauner et al.

(10) Patent No.: US 7,398,755 B1
(45) Date of Patent: Jul. 15, 2008

(54) MOUNTING PLATE FOR INTERNAL COMBUSTION ENGINE

(75) Inventors: Günther Zauner, Peuerbach (AT); Ernst Mayringer, Ruestorf (AT); Otakar Jabornik, Linz (AT)

(73) Assignee: BRP-Rotax GmbH & Co. KG, Gunskirchen (AT)

( * ) Notice: Subject to any disclaimer, the term of this patent is extended or adjusted under 35 U.S.C. 154(b) by 0 days.

(21) Appl. No.: 11/625,751

(22) Filed: Jan. 22, 2007

(51) Int. Cl.
*F02F 7/00* (2006.01)

(52) U.S. Cl. ..... 123/195 H; 180/312

(58) Field of Classification Search ..... 123/195 H, 123/195 C, 198 E, 195 R, 195 A, 41.1, 41.72, 123/198 R; 180/312, 311
See application file for complete search history.

(56) References Cited

U.S. PATENT DOCUMENTS 5,060,745 A * 10/1991 Yasui et al. ..... 180/193
6,604,600 B2 8/2003 Fournier et al.
6,644,261 B2 * 11/2003 Morii et al. ..... 123/195 R
6,651,768 B2 11/2003 Fournier et al.
6,695,087 B2 2/2004 Fournier et al.
6,725,958 B2 * 4/2004 Ashida et al. ..... 180/186
6,941,924 B2 * 9/2005 Morii et al. ..... 123/198 R
7,185,729 B2 * 3/2007 Moriyama ..... 180/291
7,255,068 B2 * 8/2007 Ashida ..... 123/41.1
7,278,382 B1 * 10/2007 Kyuma et al. ..... 123/41.82 R
2001/0040063 A1 * 11/2001 Wubbolts et al. ..... 180/183
2006/0108164 A1 * 5/2006 Wubbolts et al. ..... 180/190

* cited by examiner

*Primary Examiner*—Stephen K. Cronin
*Assistant Examiner*—Hyder Ali
(74) *Attorney, Agent, or Firm*—Osler, Hoskin & Harcourt LLP

(57) ABSTRACT

An internal combustion engine is disclosed. The internal combustion engine includes a crankcase and a mounting plate or base plate connected to the bottom portion of the crankcase. The base plate includes a plurality of engine mountings integrally formed with the base plate for securing the engine to a chassis. The base plate and the crankcase cooperate together to define at least one cooling chamber within the crankcase and cooling fluid passageways within the at least one cooling chamber.

23 Claims, 6 Drawing Sheets

MOUNTING PLATE FOR INTERNAL COMBUSTION ENGINE

FIELD OF THE INVENTION

The present invention relates to engine mountings for recreational vehicles.

BACKGROUND OF THE INVENTION

Two-stroke internal combustion engines are used to power recreational vehicles such as snowmobiles. These engines may cause large amounts of vibration. In order to decrease the amount of vibration transferred from the engine to the frame of a snowmobile, such engines are secured to the frame of the snowmobile by engine mounts attached to the bottom of the engine with position-adjustable dampers placed between the engine mounts and the frame. The dampers absorb a portion of the vibration produced by the engine. However, such conventional engine mounts are relatively bulky in order to support the weight of the engine and therefore require additional space within the frame and also require appropriate space for technicians to position the adjustable dampers and fasten the engine mounts to the frame. Conventional engine mounts typically require additional space in the frame at the front and rear of the engine.

U.S. Pat. No. 6,651,768 now assigned to Bombardier Recreational Products Inc. which is incorporated herein by reference, describes an engine mount for snowmobile that can be used when space for the engine within a frame is limited and which is easily accessible from the side of the frame for assembly and repair. The engine mount disclosed consists of a plate attached to the bottom of an engine. The engine mount includes four hollow, cylindrical attachment portions extending transversely to the longitudinal direction of the snowmobile frame, each receiving a dampening mount. Fasteners are inserted through the frame to couple with the dampening mounts and cylindrical attachment portions in a direction that is transverse to the longitudinal direction of the frame. The configuration of the dampening mounts permits effective dampening of the engine vibrations especially in a direction transverse to the direction of forward travel of the vehicle. The engine mount disclosed reduces the required space for engine mounts and for access during production and repair activities. The attachment portions are formed with the plate as a unitary, one-piece element. The plate is rigidly attached to the bottom of the engine prior to assembly into the frame.

Although, providing a mounting plate having integrated attachment portions effectively reduces the space requirements for engine mounts, the plate must extend the width of the engine in order to be fastened to the frame such that the mounting plate is a large piece of metal added to the bottom of the engine. As such, the mounting plate increases the weight of the snowmobile.

Thus, there is a need for an engine mount that alleviates some of the drawbacks of prior engine mounts and preferably reduces the weight of the snowmobile.

STATEMENT OF THE INVENTION

One aspect of the present invention is to provide an internal combustion engine including a crankcase having a bottom portion and a top portion, and a base plate connected to the bottom portion of the crankcase, the crankcase having a peripheral wall defining at least one cooling chamber and at least one partition wall inside the at least one cooling chamber for directing cooling fluid inside the at least one cooling chamber; the base plate having an inner surface, an outer surface and an outer edge joining the inner surface to outer surface, the inner surface of the base plate including at least one partition ridge, the at least one partition ridge mating with the at least one partition wall of the crankcase when the base plate is assembled to the bottom portion of the crankcase, the at least one partition ridge and the at least one partition wall together defining at least one cooling fluid passageway in the at least one cooling chamber; the base plate having a plurality of engine mountings integrally formed with the base plate and extending from the outer edge of the base plate for securing the engine to a frame.

In another aspect, the at least one partition ridge and the at least one partition wall together define at least one passageway circling the at least one cooling chamber.

In a further aspect, the base plate further comprises channels around the at least one partition ridge to improve circulation of the cooling fluid around the at least one partition wall.

In an additional aspect, at least one of the plurality of engine mountings includes a cylindrical body having an aperture extending therethrough. A resilient member is preferably inserted into the aperture.

In a further aspect, the at least one of the plurality of engine mountings is connected to the outer edge of the base plate via legs integral with the base plate.

In an additional aspect, the crankcase further comprises at least one main partition wall defining at least two cooling chambers and secondary partition walls inside each cooling chamber for directing cooling fluid inside each cooling chamber.

In another aspect, the base plate further comprises at least one main partition ridge and secondary partition ridges, the at least one main partition ridge mating with the at least one main partition wall of the crankcase and the secondary partition ridges mating with the secondary partition walls of the crankcase when the base plate is assembled to the bottom portion of the crankcase, the secondary partition ridges and the secondary partition walls together defining cooling fluid passageways in each cooling chamber.

In an additional aspect, the base plate further comprises channels around the secondary partition ridges to improve circulation of the cooling fluid around the secondary partition walls.

One additional aspect of the present invention is to provide an two-stroke internal combustion engine comprising: a crankcase; a crankshaft disposed in the crankcase; a cylinder operatively connected to the crankcase; a piston operatively connected to the crankshaft and disposed within the cylinder; a liquid cooling system comprising a cooling passageway being at least partly disposed in the crankcase; and a mounting plate including a plurality of mountings adapted to mount the engine to a structure of a vehicle; the mounting plate being removably connected to the crankcase of the engine, the cooling passageway comprising a first channel defined by the crankcase and the mounting plate such that the first channel is established when the mounting plate is connected to the crankcase.

In a further aspect, the crankshaft bearings supporting the crankshaft within the crankcase, are cooled from below by the first channel.

Embodiments of the present invention each have at least one of the above-mentioned aspects, but not necessarily have all of them.

Additional and/or alternative features, aspects and advantages of the embodiments of the present invention will become apparent from the following description, the accompanying drawings and the appended claims.

BRIEF DESCRIPTION OF THE DRAWINGS

For a better understanding of the present invention as well as other aspects and further features thereof, reference is made to the following description which is to be used in conjunction with the accompanying drawings, where.

DESCRIPTION OF PREFERRED EMBODIMENT(S)

Figure 1:
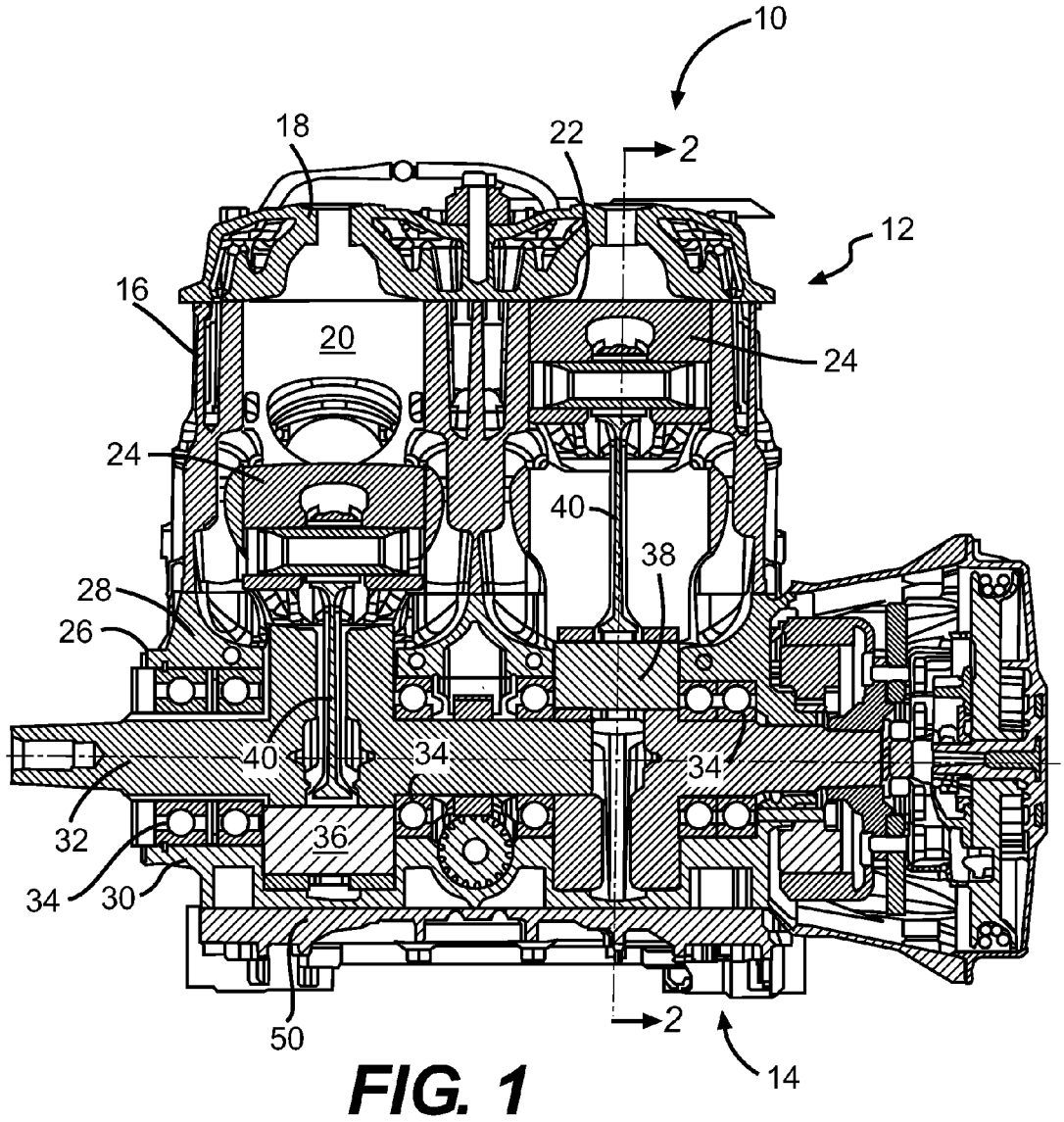
FIG. 1 is a cross-sectional view of a two-stroke internal combustion engine in accordance with one embodiment of the invention taken along the longitudinal axis of the engine.

With reference to FIG. 1, which is a cut-away view of a two-stroke internal combustion engine 10 along its longitudinal axis, the internal combustion engine 10 includes an upper portion 12 and a lower portion 14. The upper portion 12 consists of a cylinder block 16 and a cylinder head 18 which together define two combustion chamber 20 and 22 each housing a piston 24. The lower portion 14 consists of a crankcase 26 having an upper half 28 and a lower half 30 secured together and supporting a crankshaft 32 via a series of bearings 34. The bottom portion of the lower half 30 of the crankcase 26 is closed and sealed by a base plate 50. The upper portion 12 is assembled to the lower portion 14 by securing the cylinder block 16 to the upper half 28 of the crankcase 26. The pistons 24 are connected to the connecting rod journals 36 and 38 of the crankshaft 32 via connecting rods 40 such that reciprocal movement of the pistons within the cylinders is transferred to the crankshaft 32 as rotational movement. The internal combustion engine 10 includes a cooling circuit that circulates fluid throughout the engine 10 to avoid thermal overload of the engine 10 and particularly, the components surrounding the hot combustion chambers 20 and 22. The cooling fluid enters the crankcase 26 to cool the main bearings 34 and the crankcase 26 in general. The cooling fluid is then routed upwards to the cylinder block 16 and cylinder head 18 and exits the engine 10 at the top through a water outlet which can be equipped with a thermostat (not shown). The two-stroke internal combustion engine 10 is an in-line two cylinder engine having a volumetric displacement of 400 cc. In other embodiments, the two-stroke internal combustion engine 10 has a volumetric displacement of 400 cc or more. For instance, the two-stroke internal combustion engine 10 can have a volumetric displacement of 550 cc or more. In operation, the two-stroke internal combustion engine 10 is mounted to the frame of a vehicle such that the crankshaft 32 is disposed substantially horizontally.

Figure 2:
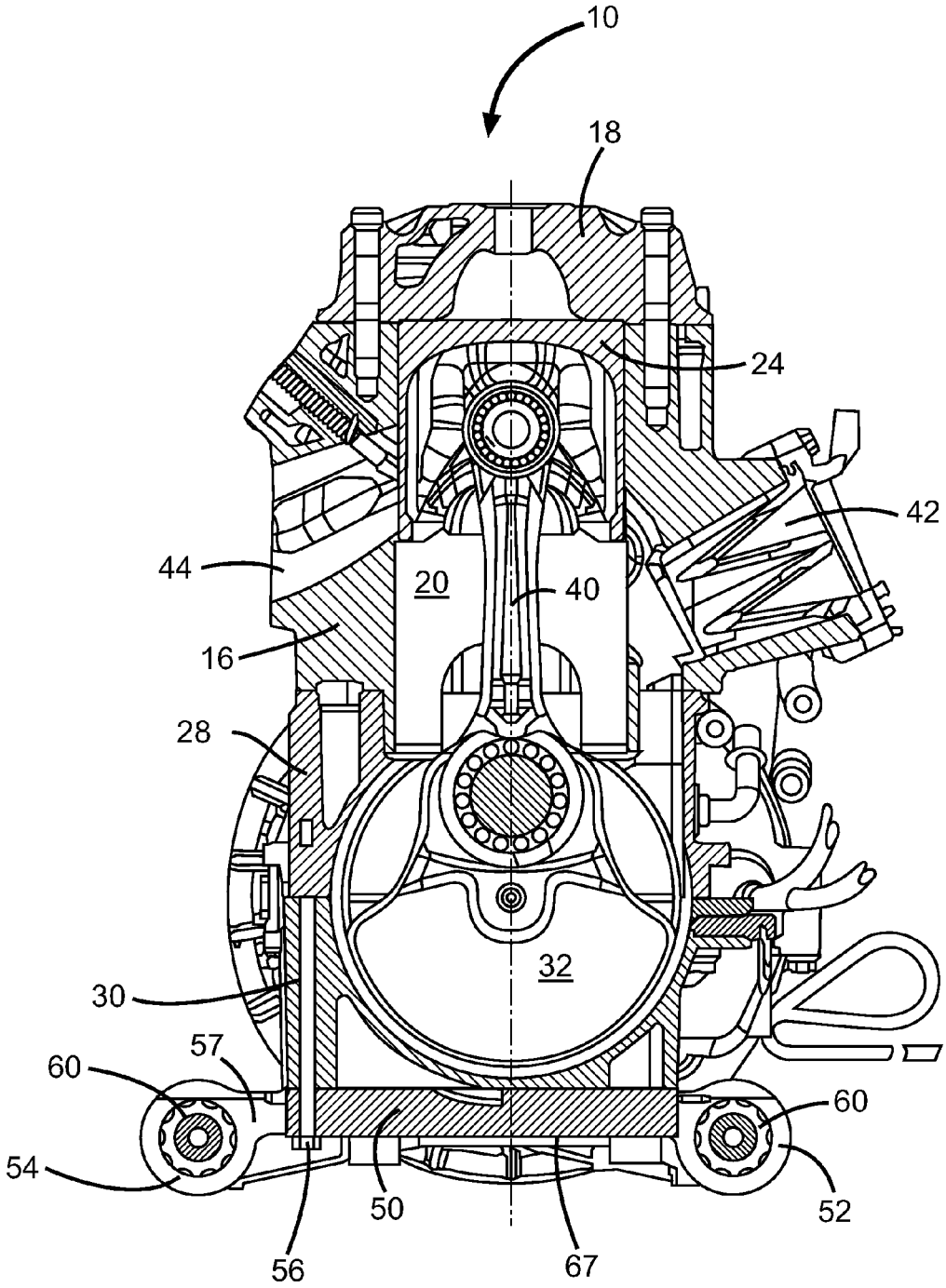
FIG. 2 is a cross-sectional view of the two-stroke internal combustion engine taken along line 2-2 of FIG. 1.

With reference to FIG. 2, which is a cut-away view of the two-stroke internal combustion engine 10 taken along line 2-2 of FIG. 1, the cylinder block 16 includes an intake port 42 which allows ingress of a fuel-air mixture into the combustion chamber 20 when the piston 24 is at the bottom end of its stroke and an exhaust port 44 which allows the burnt gas mixture to exit the combustion chamber 20 when the piston 24 is half way down its power stroke. As can be seen, the base plate 50 includes engine mounts 52 and 54 extending from the outer edge of the base plate 50 for securing the engine 10 to a frame. The engine mounts 52 and 54 are integral with the base plate 50 and form a single component. The base plate 50 is secured to the bottom portion of the lower half 30 of the crankcase 26 by a series of bolts 56 such that it closes and seals the crankcase 26 and also solidly connects the engine mounts 52 and 54 to the engine 10. The bolts 56 also secure the lower half 30 of the crankcase 26 to the upper half of the crankcase 26. The base plate 50 has a thickness and is provided with reinforcement ribs 51 (FIG. 1) such that the base plate 50 is rigid enough to withstand the forces created by the positive and negative acceleration of the engine and able to maintain the seal between the base plate 50 and the lower half 30 of the crankcase 26. The base plate 50 is also designed to resist the impacts of debris or direct impacts to the ground and protect the lower half 30 of the crankcase 26.

Each engine mount 52 and 54 is cylindrical and comprises a resilient member 60 inserted therein which dampens vibrations emanating from the engine 10. The resilient members 60 therefore partially isolate the engine 10 from the frame of the snowmobile when the engine 10 is mounted onto the frame. Resilient members 60 can be formed of rubber or other resilient material capable of appropriately dampening vibrations emanating from engine 10 and transmitted via the base plate 50. The amount of material and the type of material forming resilient members 60 can be selected to achieve the desired dampening characteristics. The thickness and structural features of the resilient member 60 will determine how much of the vibrations will be dampened. The resilient member 60 can be bonded and/or press-fitted into the engine mount 52, 54 or it can be assembled as one part on the assembly line. The range of the hardness of a rubber resilient member 60 can be between 60-80 shore A durometer. An example of the rubber material that can be used within resilient member 60 is black polyurethane, ASTM D2000 M2BG, G21, EF21, F17, Z1, Z2, Z3 or ASTM D2000 M2AA, 817, A13, B33, F17.

Figure 3:
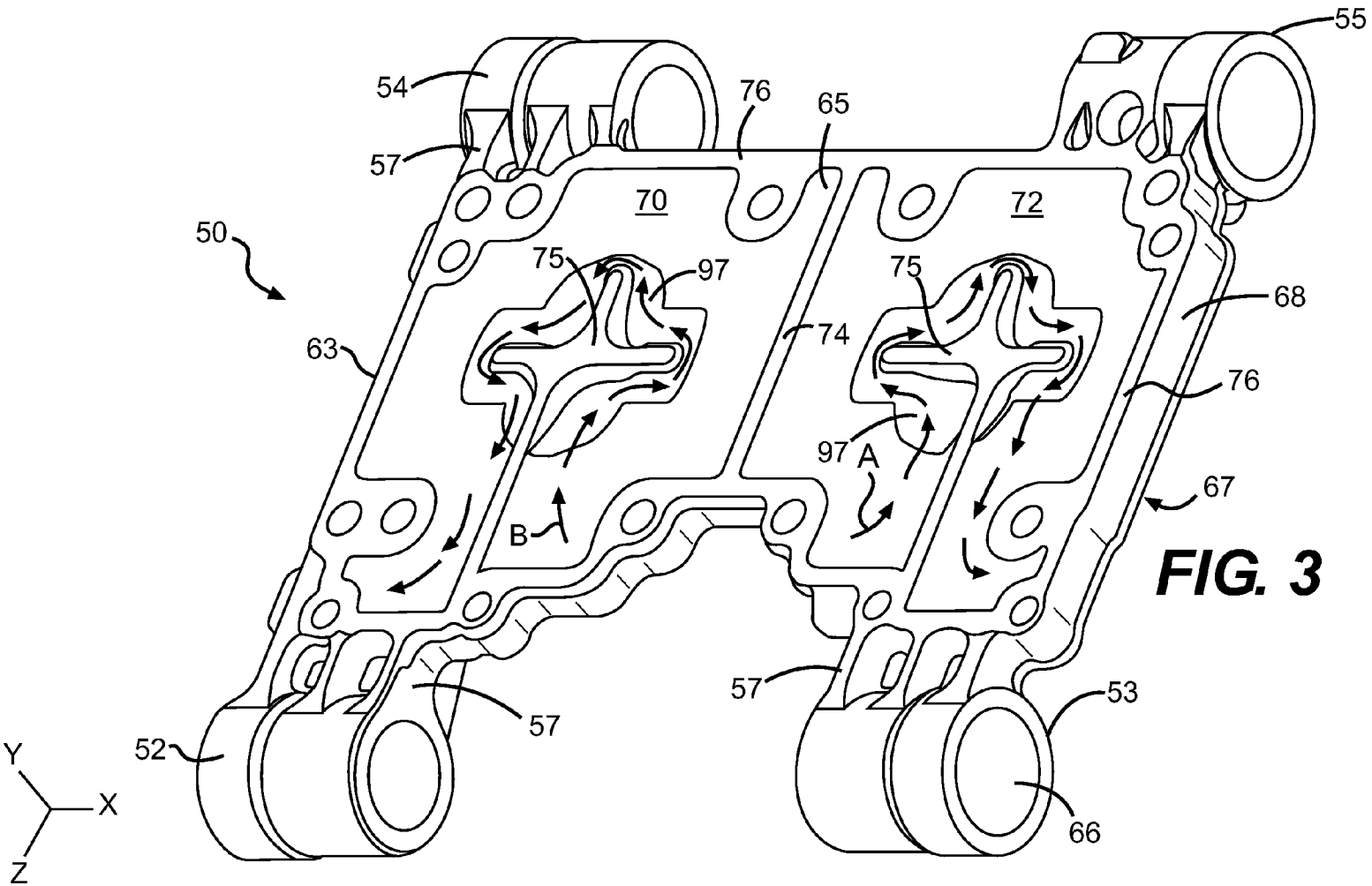
FIG. 3 is a top perspective view of the mounting plate of the two-stroke internal combustion engine of FIG. 1.

Referring now to FIG. 3, which shows the base plate 50 in isolation with its inner surface 65 facing up, the base plate 50 includes an inner surface 65, an outer surface 67 and an outer edge 68 joining the inner surface 65 to outer surface 67, and four engine mounts 52, 53, 54 and 55 extending from each corner of the base plate 50. Depending on the vehicle in which the engine 10 is mounted, the base plate can include three engine mounts or five engine mounts. The base plate 50 is a cast aluminum component including a main body 63 and the engine mounts 52, 53, 54 and 55 are integrally formed with the main body 63 in one mold and all cast together. Each engine mount 52, 53, 54 and 55 has a cylindrical body and includes an aperture 66 extending along the longitudinal axis of the engine 10 in which a resilient member 60 is inserted. A bolt (not shown) is passed through the aperture 66 and the resilient member 60 and is fastened to the frame to secures the engine 10 to the frame. In the illustrated embodiment, the engine mounts 52, 53, 54 and 55 are connected to the main body 63 by short legs 57, integral with the cast of the base plate 50, linking them to the outer edge 68 of the base plate 50.

As can be seen in FIG. 3, the inner surface 65 of the base plate 50 defines two cooling sections 70 and 72. The cooling sections 70 and 72 are defined by an outer peripheral edge 76 and separated by a main partition ridge 74. Each cooling section 70 and 72 includes a secondary partition ridge 75 which defines cooling fluid passageways illustrated by the arrows A and B in each cooling section 70 and 72. The inner surface 65 of the base plate 50 is designed to mate with the bottom portion of the lower half 30 of the crankcase 26 which is shown in detail in FIG. 4.

Figure 4:
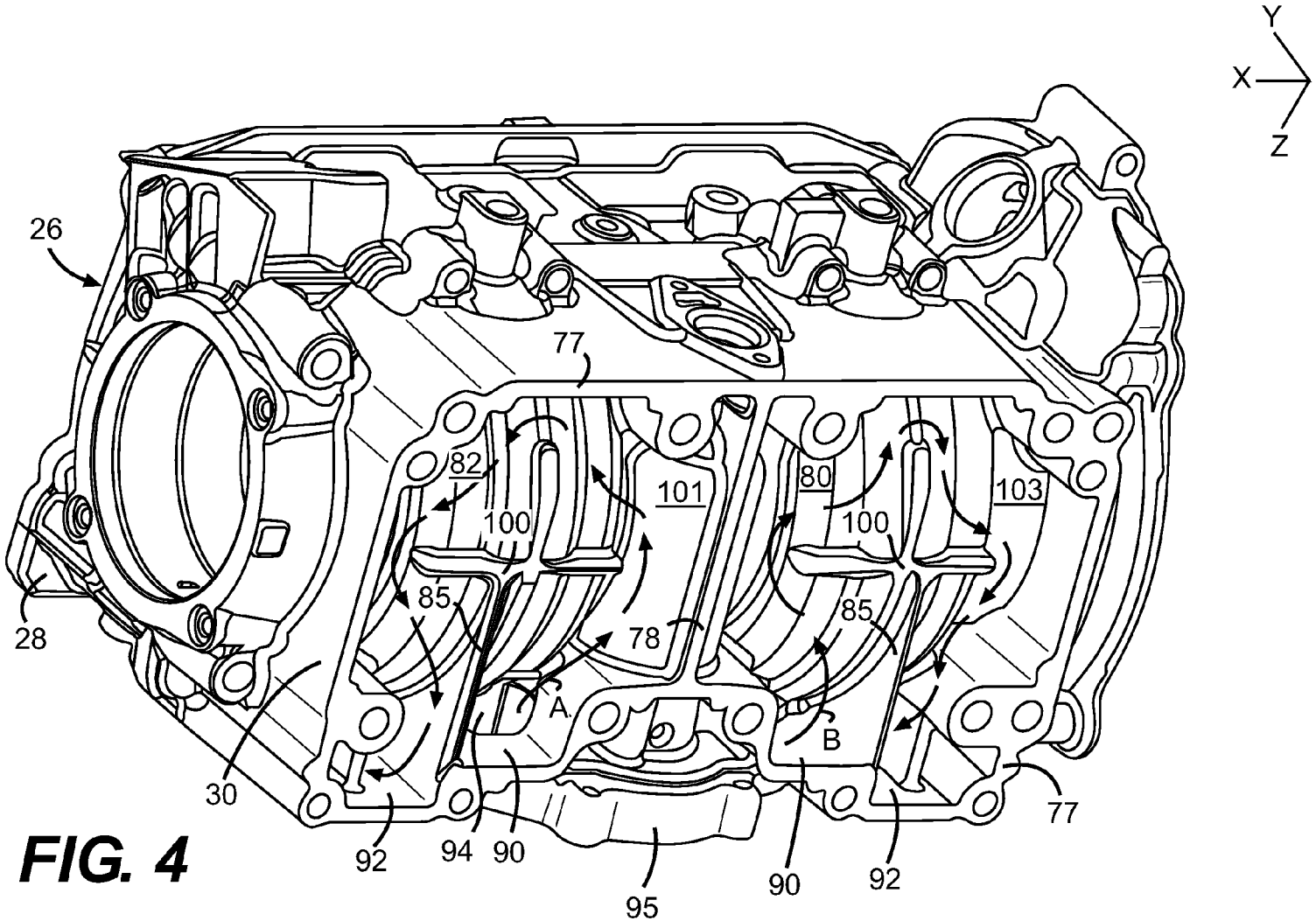
FIG. 4 is a bottom perspective view of the crankcase of the two-stroke internal combustion engine of FIG. 1.

With reference to FIG. 4, which is a bottom perspective view of the crankcase 26, the bottom portion of the lower half 30 of the crankcase 26 includes an outer peripheral edge 77 and a main partition wall 78 dividing the lower half 30 of the crankcase 26 into two cooling chambers 80 and 82. In each cooling chamber 80 and 82, there is a secondary partition wall 85 which divides each chamber 80 and 82 into an inlet side 90 and an outlet side 92. When the base plate 50 is connected to the bottom portion of the lower half 30 of the crankcase 26, the outer peripheral edge 76 of the base plate 50 mate with the outer peripheral edge 77 of the lower half 30 of the crankcase 26, the main partition ridge 74 of the base plate 50 mates with the main partition wall 78 of the lower half 30 of the crankcase 26, and the secondary partition ridges 75 of the base plate 50 mates with the secondary partition walls 85 of the lower half 30 of the crankcase 26. A gasket conforming to the outer peripheral edge 76 and to the main partition ridge 74 is positioned between the base plate 50 and the lower half 30 of the crankcase 26 to seal the two cooling chambers 80 and 82. The base plate 50 and the lower half 30 of the crankcase 26 together define cooling fluid passageways A and B as illustrated in FIGS. 3 and 4 which show the path of the cooling fluid through each chamber 80 and 82. The lower half 30 of the crankcase 26 includes a water pump mounting 95 which is in fluid communication with each cooling chamber 80 and 82 through a pair of inlet ports 94 (only one shown) located on each side of the water pump mounting 95.

With reference to FIGS. 3 and 4, cooling fluid is fed under pressure by the water pump into the inlet side 90 of each cooling chamber 80 and 82 through the inlet ports 94 and enters each cooling chamber 80 and 82 separately at the locations where the pathways A and B begin. The cooling fluid enters cooling chamber 80 and 82 and is guided by the secondary partition walls 85 such that it circles the entire cooling chambers 80 and 82 and is brought in contact with the maximum surface area of the crankcase 26. The cooling fluid circulates around the central portions 100 of the secondary partition walls 85 from the inlet side 90 to the outlet side 92 as it follows the pathways A and B around the cooling chambers 80 and 82. As best shown in FIG. 3, channels 97 are disposed around the secondary partition ridges 75 of the base plate 50 to provide sunken channels for the cooling fluid to circulate around the central portions 100 of the secondary partition walls 85 where space is limited due to the close proximity of the crankcase wall where the connecting rod journals 36 and 38 (FIG. 1) of the crankshaft 32 are located. The cooling fluid follows the general path indicated by arrows A and B and in the process cools the lower half of the main bearing housings 101 and 103 of the crankcase 26 as well as the entire lower half 30 of the crankcase 26 itself. The cooling fluid then exits the cooling chambers 80 and 82 on the outlet side 92 though outlet ports (not shown) leading to the upper half 28 of the crankcase 26.

The base plate 50 has the combined multiple functions of sealing the lower half 30 of the crankcase 26 and separating the cooling chambers 80 and 82, defining the cooling fluid passageways within each cooling chamber 80 and 82, and securing the engine 10 to the frame of the vehicle it is to be mounted on. As such, the base plate 50 is an integral part of the cooling system of engine 10 as well as the providing the means for securing the engine 10 to a frame providing the advantage of reduced weight and compactness relative to prior art engine mounting systems.

The two-stroke engine 10 is preferably installed in a recreational vehicle such as a snowmobile or an All-Terrain Vehicle (ATV).

Figure 5:
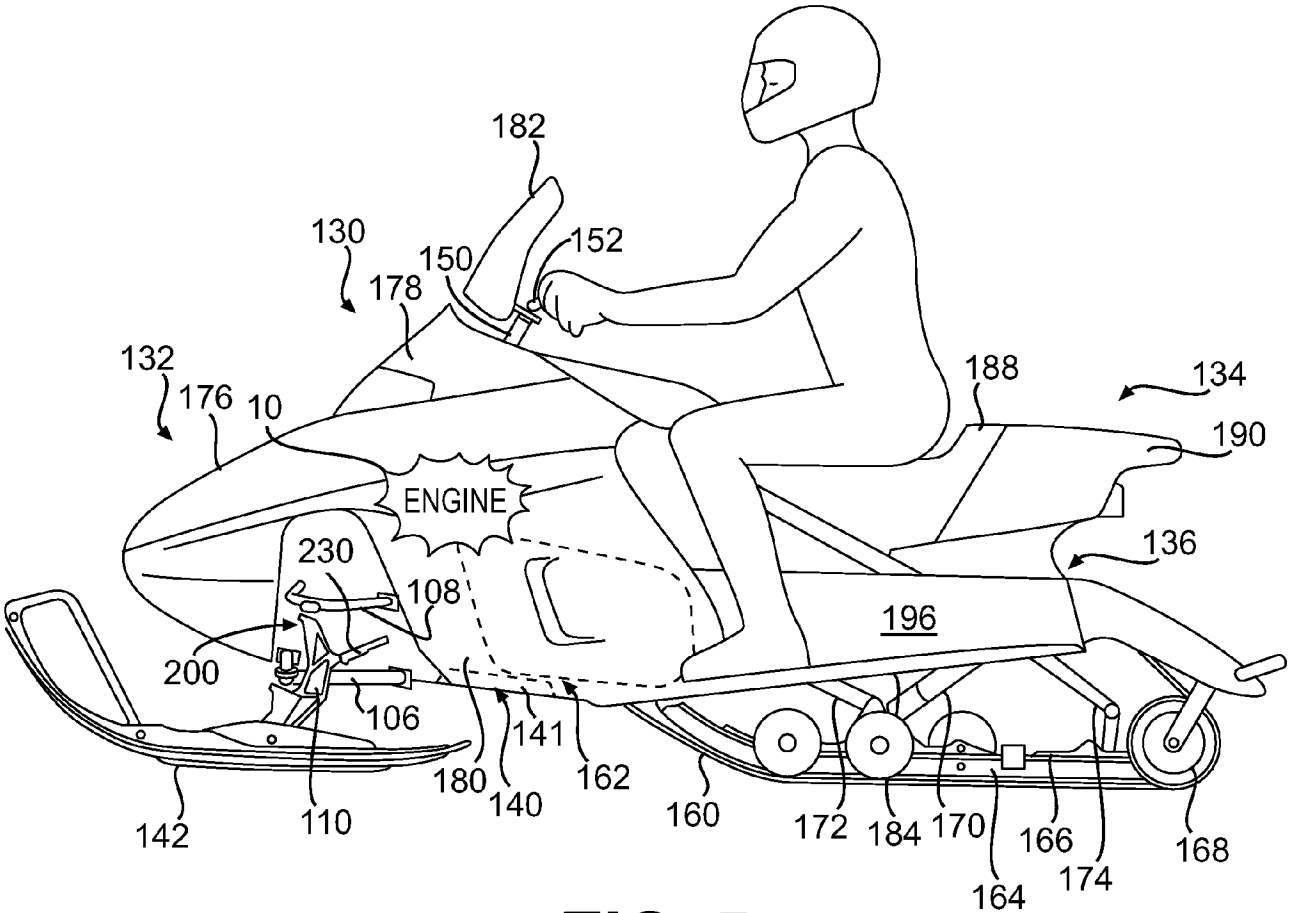
FIG. 5 is a side elevational view of a snowmobile including a two-stroke internal combustion engine in accordance with one embodiment of the invention.
Figure 6:
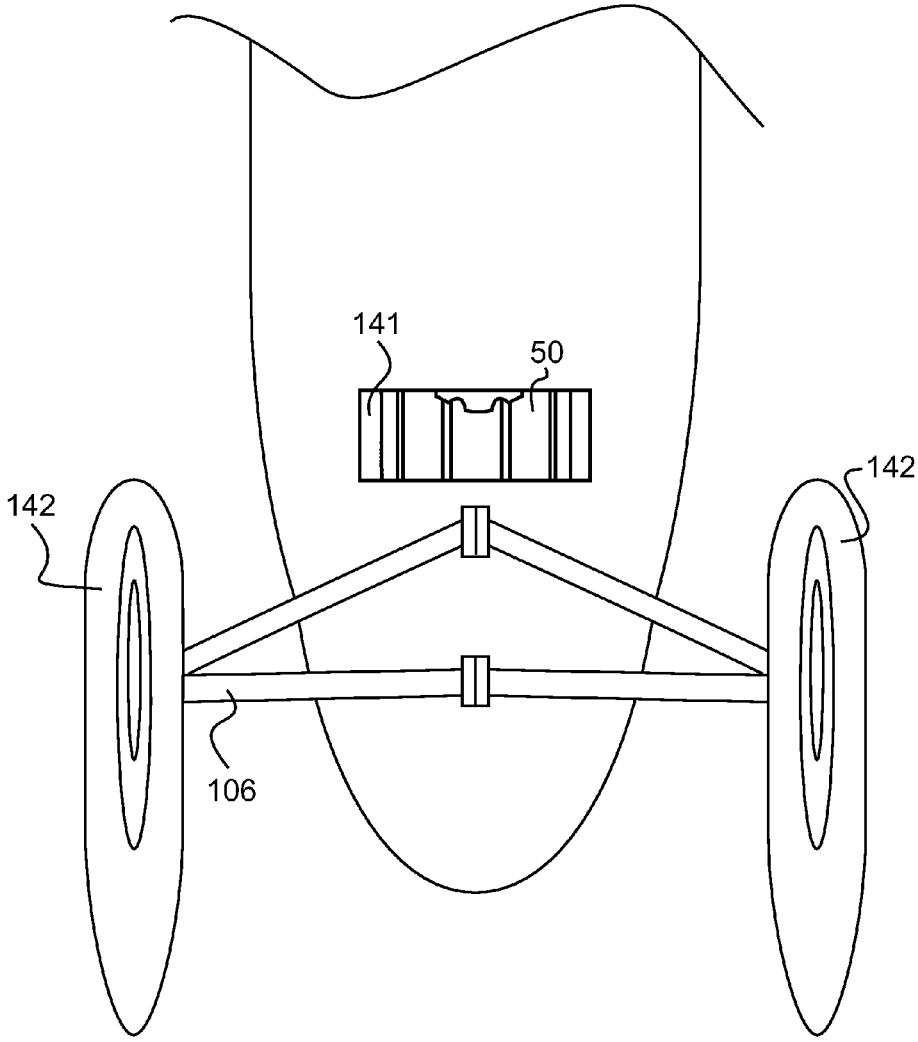
FIG. 6 is a schematic bottom plan view of the front portion of the snowmobile shown in FIG. 5.

FIG. 5 illustrates a snowmobile 130 in accordance with one specific embodiment of the invention. The snowmobile 130 includes a forward end 132 and a rearward end 134 which are defined consistently with a travel direction of the vehicle. The snowmobile 130 includes a frame 136 comprising an engine cradle portion 140 and a tunnel 196. While hidden behind a front fairing 154, the two-stroke engine 10, schematically illustrated, provides motive force for the snowmobile 130 and is carried by the engine cradle portion 140 of the frame 136. The engine 10 is mounted to the engine cradle portion 140 of the frame 136 via bolts passed through the engine mounts 52, 53, 54 and 55 of the base plate 50 which secure the engine 10 to the frame 136. The engine 10 is disposed within an engine compartment disposed in front of the endless drive track 160, which is at least partially defined by an engine hood 178 and the engine cradle 140. In a specific embodiment of the snowmobile 130, the engine cradle 140 includes an opening 141, best shown in FIG. 6, located under the snowmobile to allow air and snow to enter therethrough and provide cooling for the base plate 50. The base plate 50 is designed to shield and protect the crankcase 26 of the engine 10 against debris entering through the opening or from direct impacts. As previously described, the base plate 50 is sufficiently thick and provided with reinforcement ribs to resist direct impacts and impacts from debris. Since the base plate 50 is removable, in the event that the base plate 50 is damaged by debris or direct impacts, the damaged base plate 50 can be easily replaced. The robustness of the base plate 50 enables the engine protective plate typically found under the engine of snowmobile to be dispensed with and therefore further reduces the weight of the snowmobile.

Two front skis 142 are attached to the front portion of the frame 136 through a front suspension system 200 in accordance with one embodiment of the invention. The front suspension system 200 generally comprises a double A-arm type suspension, having upper A-arms 108 and lower A-arms 106 on either side of the vehicle linking the spindles 110 to the frame 136. The spindles 110 are attached to the skis 142 at their lower ends and rotate left and right therewith. The spindles 110 are also connected to a steering column 150 via steering rods 130. The steering column 150 is attached at its upper end to a steering device such as a handlebar 152 which is positioned forward of a rider and slightly behind the engine 10 to rotate the skis 142, thereby providing directional control of the snowmobile 130. Thus, by turning the steering device 152, the spindles 110 are pivoted and the skis 142 are turned to steer the snowmobile 130 in a desired direction.

An endless drive track 160 is disposed under the tunnel 196 of the frame 136 with the upper portion of the drive track 160 accommodated within the tunnel 196. The endless drive track 160 is operatively connected to the engine 10 through a belt transmission system 162 which is schematically illustrated by broken lines. The endless drive track 160 is driven to run about a rear suspension assembly 164 for propulsion of the snowmobile 130. The rear suspension assembly 164 includes a pair of slide rails 166 which generally position and guide the endless drive track 160 and include idler wheels 168 engaged thereto. The slide rails 166 typically include a sliding lower surface made of polyethylene to reduce contact friction between the slide rails 166 and the drive track 160. The rear suspension assembly 164 also includes one or more shock absorbers 170 which may further include a coil spring (not shown) surrounding the individual shock absorbers 170. Rear suspension arms 172 and 174 are provided to attach the slide rails 166 and idler wheels 168 to the tunnel 196 of the frame 136.

At the front end 132, the snowmobile 130 includes an external shell consisting of fairings 176 that enclose and protect the engine 10 and transmission 162 and that can be decorated to render the snowmobile 130 more aesthetically pleasing. Typically, the fairings 176 include a hood 178 and one or more side panels 180 which can be opened to allow access to the engine 10 and the transmission 162 when this is required, for example, for inspection or maintenance. The side panels 180 can be opened away from the snowmobile 130 along a vertical axis, independently from the hood 178, which pivots forward about a horizontally extending axis. A windshield 182, which may be connected either to the fairings 176 or directly to the handlebars 152, acts as wind deflector to lessen the force of the air on the rider when the snowmobile is moving.

A straddle-type seat 188 is positioned atop and mounted to the tunnel 196 and extends from the rear end 134 of the snowmobile 130 to the fairings 176. Two footrests 184, generally extending outwardly from the tunnel 196, are also positioned on either side of the straddle seat 188 to accommodate the rider's feet and provide a rigid platform for the rider to stand on when maneuvering the snowmobile 130. A rear portion of the straddle seat 88 may include a storage compartment 190 or a passenger seat (not shown).

Modifications and improvement to the above described embodiments of the present invention may become apparent to those skilled in the art. The foregoing description is intended to be exemplary rather than limiting. Furthermore, the dimensions of features of various components that may appear on the drawings are not meant to be limiting, and the size of the components therein can vary from the size that may be portrayed in the figures herein. The scope of the present invention is therefore intended to be limited solely by the scope of the appended claims.

What is claimed is:

1. An internal combustion engine including a crankcase having a bottom portion and a top portion, and a base plate connected to the bottom portion of the crankcase, the crankcase having a peripheral wall defining at least in part at least one cooling chamber and at least one partition wall inside the at least one cooling chamber;

the base plate having an inner surface, an outer surface and an outer edge joining the inner surface to outer surface, the inner surface of the base plate including at least one partition ridge, the at least one partition ridge mating with the at least one partition wall of the crankcase when the base plate is assembled to the bottom portion of the crankcase, the at least one partition ridge and the at least one partition wall together defining at least one cooling fluid passageway in the at least one cooling chamber; the base plate having a plurality of engine mountings integrally formed with the base plate and extending from the outer edge of the base plate for securing the engine to a frame.

2. An internal combustion engine as defined in claim 1, wherein the base plate further comprises channels around the at least one partition ridge to improve circulation of the cooling fluid around the at least one partition wall.

3. An internal combustion engine as defined in claim 2, wherein the channels are recessed into the inner surface of the base plate.

4. An internal combustion engine as defined in claim 1, wherein the at least one partition ridge and the at least one partition wall together define at least one passageway circling the at least one cooling chamber.

5. An internal combustion engine as defined in claim 1, wherein at least one of the plurality of engine mountings includes a cylindrical body having an aperture extending therethrough.

6. An internal combustion engine as defined in claim 5, further comprising a resilient member inserted into the aperture.

7. An internal combustion engine as defined in claim 5, wherein the aperture of the at least one of the plurality of engine mountings extends along a longitudinal axis of the engine.

8. An internal combustion engine as defined in claim 1, wherein at least one of the plurality of engine mountings is connected to the outer edge of the base plate via legs integrally cast with the base plate.

9. An internal combustion engine as defined in claim 1, wherein the crankcase further comprises at least one main partition wall defining at least two cooling chambers and secondary partition walls inside each cooling chamber for directing cooling fluid inside each cooling chamber.

10. An internal combustion engine as defined in claim 9, wherein the base plate further comprises at least one main partition ridge and secondary partition ridges, the at least one main partition ridge mating with the at least one main partition wall of the crankcase and the secondary partition ridges mating with the secondary partition walls of the crankcase when the base plate is assembled to the bottom portion of the crankcase, the secondary partition ridges and the secondary partition walls together defining cooling fluid passageways in each cooling chamber.

11. An internal combustion engine as defined in claim 10, wherein the base plate further comprises channels around the secondary partition ridges to improve circulation of the cooling fluid around the secondary partition walls.

12. An internal combustion engine comprising:

a crankcase;

a crankshaft disposed in the crankcase;

at least one cylinder;

a piston operatively connected to the crankshaft and disposed within the at least one cylinder;

a liquid cooling system comprising a cooling passageway being at least partly disposed in the crankcase; and a mounting plate including a plurality of mountings for mounting the engine to a structure of a vehicle; the mounting plate being removably connected to the crankcase of the engine, the cooling passageway comprising a first channel defined by the crankcase and the mounting plate such that the first channel is established when the mounting plate is connected to the crankcase; and the internal combustion engine operating on a two-stroke principal.

13. An internal combustion engine as defined in claim 12, wherein the first channel is disposed at a bottom portion of the crankcase.

14. An internal combustion engine as defined in claim 12, wherein the crankcase is cooled from below by the first channel.

15. An internal combustion engine as defined in claim 14, further comprising crankshaft bearings supporting the crankshaft within the crankcase, wherein the crankshaft bearings are cooled from below by the first channel.

16. An internal combustion engine as defined in claim 12, wherein the mounting plate includes four mountings adapted to mount the engine to a structure of a vehicle.

17. An internal combustion engine as defined in claim 12, comprising two cylinders.

18. An internal combustion engine as defined in claim 17, having a volumetric displacement of 400 cc or more.

19. A snowmobile comprising:

a frame having a front portion and a rear portion;

a drive track disposed below and supporting the rear portion of the frame;

a front suspension connected to the front portion of the frame;

a two-stroke engine mounted on the frame and connected to the drive track via a drive train for delivering propulsive power to the drive track;

two skis connected to the front portion of the frame via the front suspension, and a steering assembly connected to the skis for steering the snowmobile;

the two-stroke engine including a crankcase;

a crankshaft disposed in the crankcase;

at least one cylinder;

a piston operatively connected to the crankshaft and disposed within the at least one cylinder;

a liquid cooling system comprising a cooling passageway being at least partly disposed in the crankcase; and a mounting plate including a plurality of mountings mounting the engine to the frame of the snowmobile; the mounting plate being removably connected to the crankcase of the engine, the cooling passageway comprising a first channel defined by the crankcase and the mounting plate such that the first channel is established when the mounting plate is connected to the crankcase.

20. A snowmobile comprising:

a frame having a front portion and a rear portion;

a drive track disposed below and supporting the rear portion of the frame;

a front suspension connected to the front portion of the frame;

an engine compartment disposed at least partially in front of the drive track, the engine compartment being at least partially defined by a fairing and the frame, the engine compartment having an opening under the snowmobile;

a two-stroke engine disposed in the engine compartment and mounted on the frame, two-stroke engine operatively connected to the drive track via a drive train for delivering propulsive power to the drive track;

two skis connected to the front portion of the frame via the front suspension, and a steering assembly connected to the skis for steering the snowmobile;

the two-stroke engine including a crankcase;

a crankshaft disposed in the crankcase;

at least one cylinder;

a piston operatively connected to the crankshaft and disposed within the at least one cylinder;

a mounting plate including a plurality of mountings mounting the two-stroke engine to the frame within the engine compartment; the mounting plate being removably connected to the crankcase of the engine, the two-stroke engine being disposed above the opening of the engine compartment such that the mounting plate is cooled by at least one of air and snow entering through the opening from outside, the mounting plate shielding the crankcase from debris entering through the opening.

21. A snowmobile as defined in claim 20, wherein the two-stroke engine further comprises a liquid cooling system including a cooling passageway disposed at least partly in the crankcase; the mounting plate includes an inner surface and an outer surface, the inner surface of the mounting plate having at least one partition ridge defining at least one channel of the cooling passageway when the mounting plate is assembled to the crankcase.

22. A snowmobile as defined in claim 21, wherein the two-stroke engine further comprises crankshaft bearings supporting the crankshaft within the crankcase, wherein the crankshaft bearings are cooled from below by the at least one channel.

23. A snowmobile as defined in claim 20, wherein the mounting plate includes reinforcement ribs.

* * * * *